US012048342B2

(12) United States Patent
Bonhomme

(10) Patent No.: US 12,048,342 B2
(45) **Date of Patent: *Jul. 30, 2024**

(54) SWIM CAP

(71) Applicant: Charis D. Bonhomme, New Albany, OH (US)

(72) Inventor: Charis D. Bonhomme, New Albany, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/106,069

(22) Filed: Feb. 6, 2023

(65) Prior Publication Data

US 2023/0180876 A1 Jun. 15, 2023

Related U.S. Application Data

(63) Continuation of application No. 16/545,682, filed on Aug. 20, 2019, now Pat. No. 11,571,035.

(60) Provisional application No. 62/721,300, filed on Aug. 22, 2018.

(51) Int. Cl.
*A42B 1/12* (2006.01)
*A42C 1/00* (2006.01)

(52) U.S. Cl.
CPC . *A42B 1/12* (2013.01); *A42C 1/00* (2013.01)

(58) Field of Classification Search
CPC .. A42B 1/12; A42B 1/04; A42B 1/041; A42B 1/045; A42B 1/049; A45D 8/40
USPC ..... 2/68
See application file for complete search history.

(56) References Cited

U.S. PATENT DOCUMENTS

| | | | | | |
|---|---|---|---|---|---|
| 1,746,427 | A * | 2/1930 | Howland | A42B 1/12 | 36/8.1 |
| 2,726,398 | A * | 12/1955 | Cooper | A42B 1/12 | 2/174 |
| 3,247,521 | A | 4/1966 | Owen | | |
| 5,046,193 | A * | 9/1991 | Foresman | A42B 7/00 | 2/200.2 |
| 6,052,825 | A | 4/2000 | Dodd | | |
| 8,209,778 | B2 | 7/2012 | Matsumoto | | |
| 9,538,799 | B2 | 1/2017 | Dodd | | |
| 2010/0192273 | A1 | 8/2010 | Dodd | | |
| 2015/0359284 | A1 * | 12/2015 | Watson | A42B 1/12 | 2/174 |
| 2016/0309824 | A1 | 10/2016 | Ulian et al. | | |
| 2018/0027912 | A1 | 2/2018 | Esteve | | |
| 2019/0381360 | A1 | 12/2019 | Yoemans et al. | | |

* cited by examiner

*Primary Examiner* — F Griffin Hall
(74) *Attorney, Agent, or Firm* — Standley Law Group LLP; Beverly A. Marsh; Adam J. Smith

(57) ABSTRACT

A swim cap and a method for producing the same is disclosed. A lower portion of the swim cap is shaped as a band, and an upper portion is dome shaped. Stitching joins the lower portion to the upper portion along a horizontal seam. At least two pieces of the lower portion, and a first and second piece of the upper portion, are joined to one another with stitching along a first vertical seam. The second and a third piece of the upper portion are joined to one another with stitching along a second vertical seam. The lower and upper portions are comprised of a substantially waterproof material.

6 Claims, 8 Drawing Sheets

SWIM CAP

CROSS-REFERENCE TO RELATED APPLICATIONS

This application is a continuation of U.S. Non-Provisional application Ser. No. 16/545,682 filed on Aug. 20, 2019, which claims the priority of U.S. Provisional Patent Application Ser. No. 62/721,300 filed on Aug. 22, 2018. The disclosures of each of which are hereby incorporated by reference as if fully restated herein.

TECHNICAL FIELD

Exemplary embodiments relate generally to a swim cap and a method for producing the same.

BACKGROUND AND SUMMARY OF THE INVENTION

Swim caps are known which are generally used keep a swimmer's hair dry. Alternatively, or additionally, such swim caps are generally used to improve a swimmer's aerodynamics in the water. For example, hair is gathered under the cap which provides a relatively smooth outer surface, improving the swimmer's ability to cut through the water. However, known swim caps are uncomfortable to wear, particularly for extended periods of time. Furthermore, such caps are generally not very durable and may break after only a few uses. What is needed is a swim cap which is durable and comfortable to wear.

A swim cap which is durable and comfortable to wear is provided. An upper portion may be comprised of a first, second, and third piece. A lower portion may be comprised of a first and second piece. A first vertical seam may extend between the first and second pieces of the upper portion as well as the first and second pieces of the lower portion. A second vertical seam may extend between the second and third pieces of the upper portion. A horizontal seam may extend between the upper and lower portions. The various pieces may be joined along the various seams by stitching, heat seal, some combination thereof, or the like. The first and third pieces of the upper portion may be substantially semi-circular in shape. The second piece of the upper portion may be substantially rectangular in shape. The lower portion may be configured to form a band. The upper portion may be configured to form a dome. The upper and lower portions may be comprised of a waterproof and stretchable material, such as neoprene. The lower portion may be configured to stretch laterally while the upper portion may be configured to stretch vertically. The dome shape, and/or the use of stretchable material, may permit a significant amount of hair to be placed inside the swim cap. The inner surface of the upper and lower portions may have a relatively low coefficient of friction such that the swim cap can be easily placed and removed from the user's head without pulling on hair or otherwise causing discomfort.

A strap may be provided which has hooks on either end that are configured to mate with loops sewn to the lower portion. A grippy material having a relatively high coefficient of friction may be provided in two strips circumscribing an inner surface of the lower portion. The lower portion may comprise a double layer of material while the upper portion may comprise a single layer of material. A waterproof material may be applied along an inner surface of the various seams to further seal the swim cap. The lower portion may be tapered to better fit a user's head.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
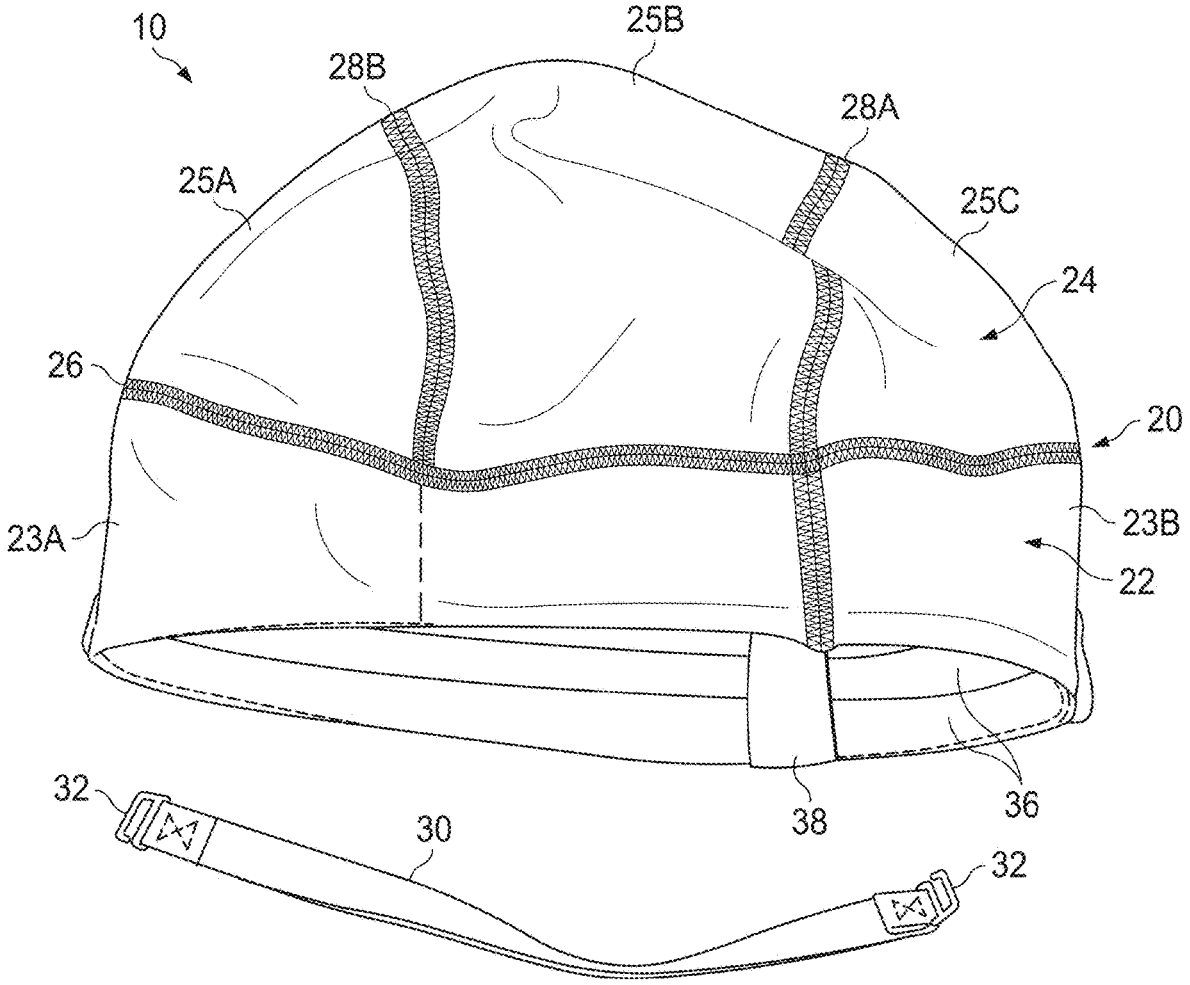
FIG. 1 is a front view of an exemplary swim cap.
Figure 2:
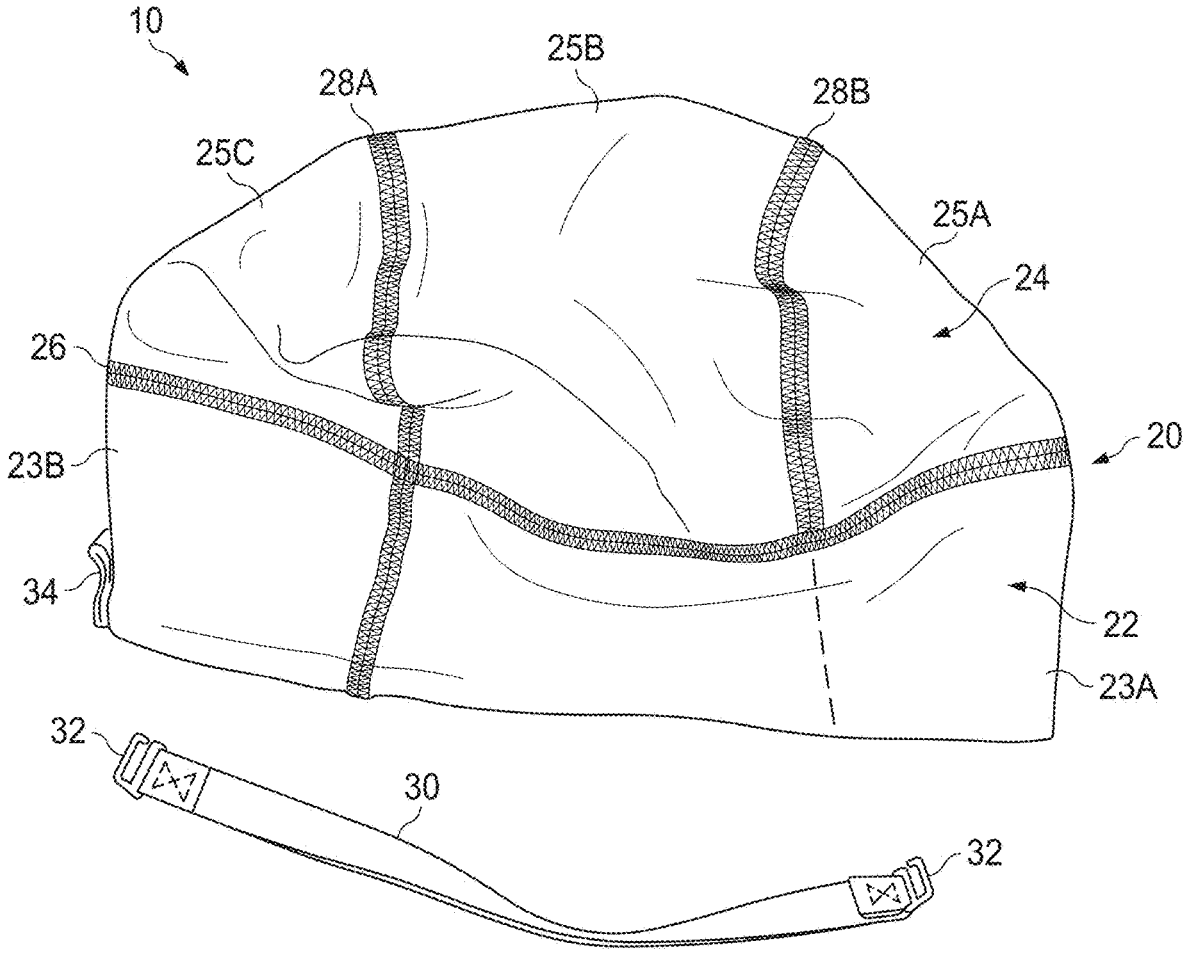
FIG. 2 is a rear view of the swim cap of FIG. 1.
Figure 3:
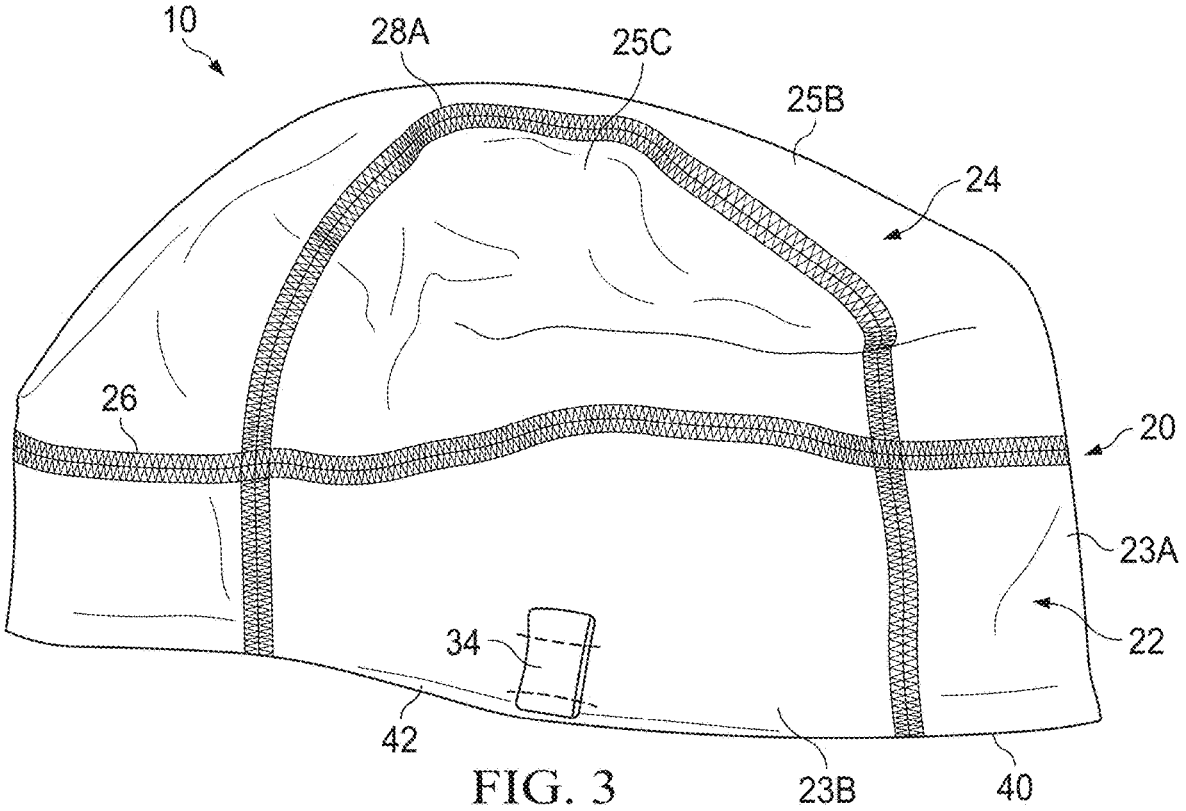
FIG. 3 is a side view of the swim cap of FIG. 1.
Figure 4:
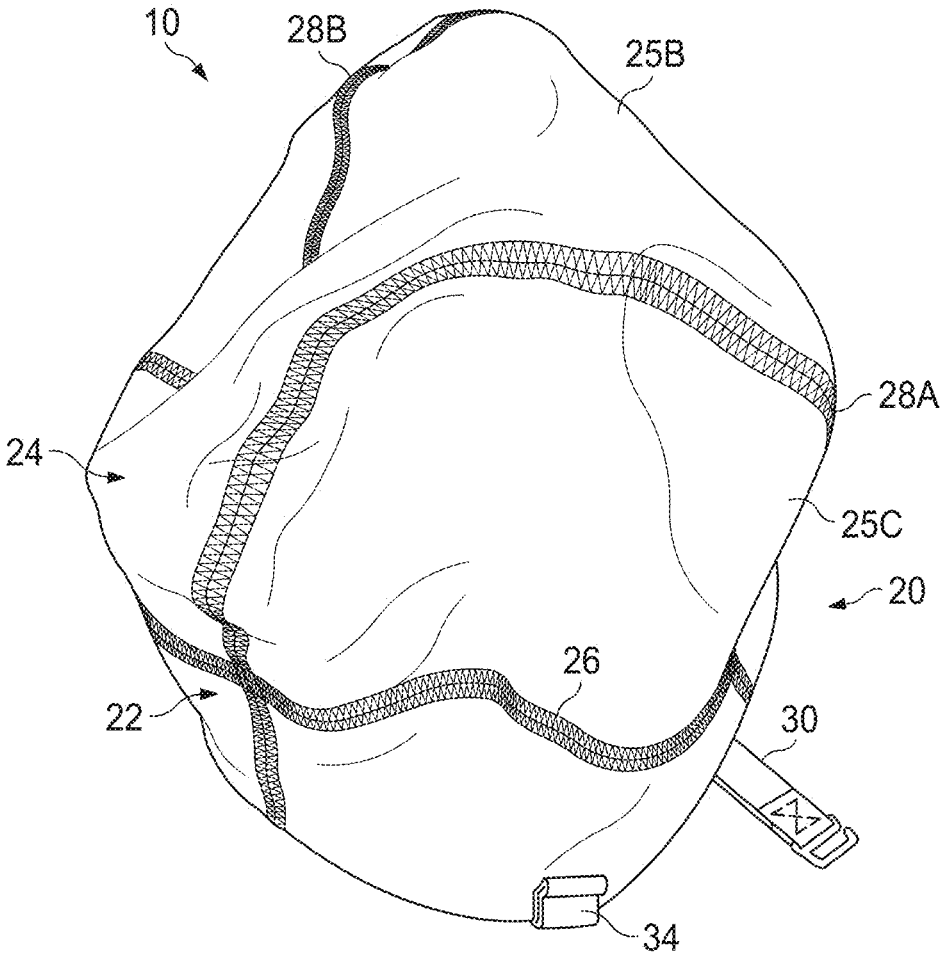
FIG. 4 is a side perspective view of the swim cap of FIG. 1.
Figure 5:
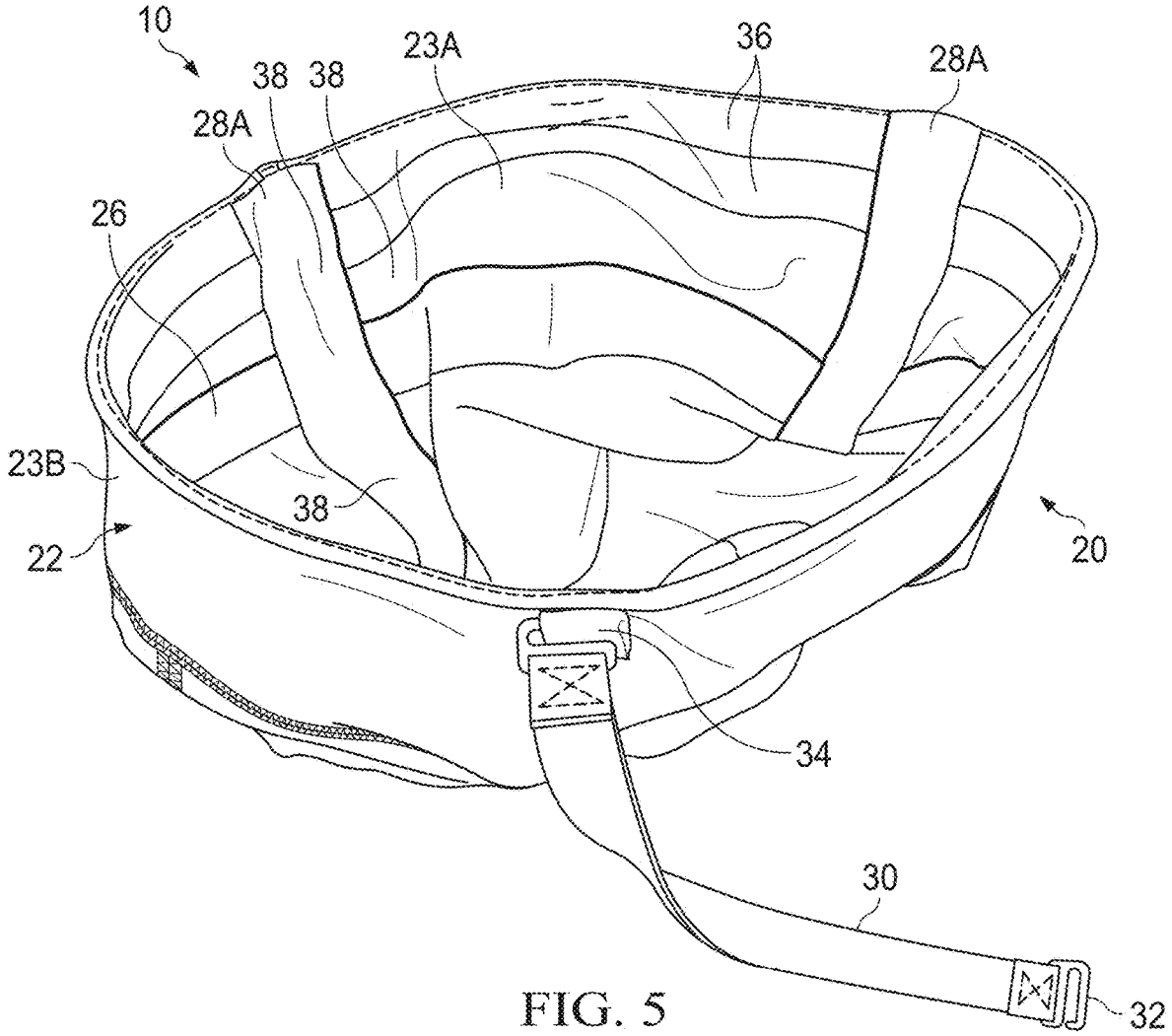
FIG. 5 is a bottom perspective view of the swim cap of FIG. 1.
Figure 6:
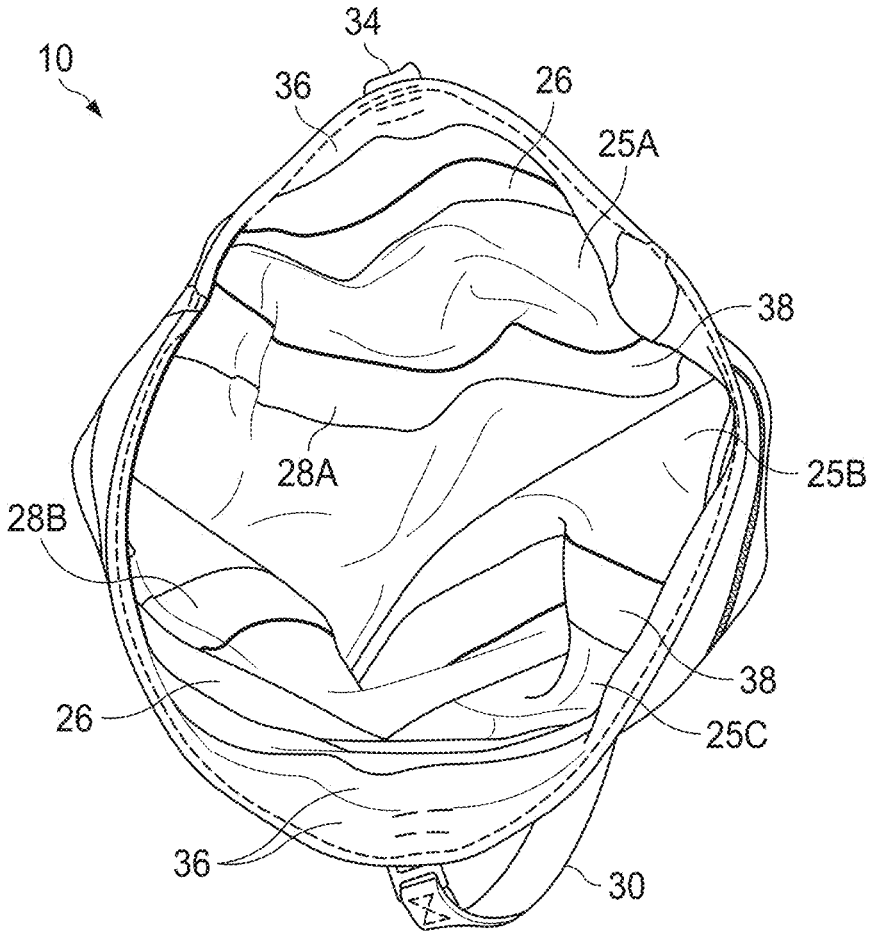
FIG. 6 is a bottom view of the swim cap of FIG. 1.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 6 illustrate various view of an exemplary swim cap 10. The swim cap 10 may comprise a covering portion 20. The swim cap 10 may further comprise a strap 30, though such is not required. The covering portion 20 may comprise an upper portion 24 and a lower portion 22. The upper portion 24 may be substantially dome shaped, though any shape is contemplated. The upper portion 24 may be configured to cover an upper portion of a user's head, such as but not limited to, the hair. The lower portion 22 may form a band configured to cover a portion of the user's head, such as but not limited to, the forehead. In exemplary embodiments, the lower portion 22 may be configured to secure the covering portion 20 on the user's head and the upper portion 24 may be configured to secure the user's hair (if any) and/or cover the upper and rear portions of the user's head. The lower portion 22 may be substantially cylindrical in shape, though any shape is contemplated.

The lower portion 22 may be formed from one or more pieces of material which may be connected to form a band at a first vertical seam 28A. In exemplary embodiments, the lower portion 22 may be comprised of a first lower piece 23A and a second lower piece 23B which may be joined to one another along the first vertical seam 28A. The upper portion 24 may be comprised of a number of pieces of material which may be connected along the first vertical seam 28A and/or a second vertical seam 28B to form the dome shape. Joining may be done by way of stitching, heat seal, some combination thereof, or the like. In exemplary embodiments, the upper portion 24 may be formed by a first upper piece 25A, second upper piece 25B, and third upper piece 25C. The first and third upper pieces 25A and 25C, respectively, may be substantially semi-circular in shape, though any shape is contemplated. The second upper piece 25B of material may be substantially rectangular in shape, though any shape is contemplated.

The first vertical seam 28A may extend into the lower portion 22 to connect the various portions of the same while the second vertical seam 28B may extend though only the upper portion 24. However, in other exemplary embodiments, the second vertical seam 28B may also extend into the lower portion 22, though such is not required. The same may be illustrated by dashed lines in the accompanying figures. In such embodiments, the second vertical seam 28B may not be joined by stitching, though such is contemplated. The lower portion 22 may be connected to the upper portion 24 along a horizontal seam 26. The horizontal seam 26 may extend around a circumference of the covering portion 20, though such is not required.

The lower portion 22 and the upper portion 24 may be comprise of a substantially waterproof material, such as but not limited to, neoprene. The waterproof material may be a waterproof textile. In exemplary embodiments, the material may be stretchable, though such is not required. In exemplary embodiments, one or more pieces of material comprising the lower portion 22 may be provided such that the material is configured to stretch in a substantially lateral direction. In exemplary embodiments, one or more pieces of material comprising the upper portion 24 may be provided such that the material is configured to stretch in a substantially vertical direction. The inner surface of some or all of the covering portion 20 may have a relatively low coefficient of friction such that the swim cap 10 can be easily placed and removed from the user's head without pulling on hair or otherwise causing discomfort. For example, without limitation, the inner surface of some or all of the covering portion 20 may have a lower coefficient of fiction as compared to the outer surface of the swim cap 10.

The dome shape of the covering portion 20, and/or the use of stretchable material, may permit a significant amount of hair to be placed inside the swim cap. In exemplary embodiments, multiple size caps 10 may be provided to accommodate varying amounts of hair.

The lower portion 22 may comprise a double layer of material to provide additional structural integrity and to improve the watertight seal with the user's head, though such is not required. In exemplary embodiments, the one or more pieces of material comprising the lower portion 22 may be folded over themselves to provide the double layer. The pieces of material forming the upper portion 24 may be provided in a single layer, though such is not required.

The strap 30 may be comprised of neoprene or an elastic material, though any type of material is contemplated. The strap 30 may comprise one or more hooks 32. In exemplary embodiments, the hooks 32 are located on either end of the strap 30, though such is not required. For example, without limitation, one or more ends of the strap 30 may be sewn or otherwise attached to the covering portion 20. The hooks 32 may be configured to be selectively secured to one or more loops 34 located on the covering portion 20. In exemplary embodiments, a loop 34 is located on each side of the lower portion 22, though any number and location of loops 34 is contemplated. In other exemplary embodiments, other devices for securing the strap 30 to the covering portion 20 are contemplated such as, but not limited to, buckles, fasteners, pins, buttons, zippers, some combination thereof, or the like.

A sealant 38 may be placed along some or all of one or more of the vertical seams 28A and 28B and/or the horizontal seam 26. The sealant 38 may be a liner, adhesive, waterproofing substance, or the like. Preferably, the sealant 38 is located on an inner surface of the covering portion 20, though such is not required. In exemplary embodiments, the various seams, such as but not limited to the vertical seams 28A and 28B and/or the horizontal seam 26 may be joined by heat sealing. Additionally, or alternatively, the various seams, such as but not limited to the vertical seams 28A and 28B and/or the horizontal seam 26 may be joined by stitching. Additionally, or alternatively, various seams, such as but not limited to the vertical seams 28A and 28B and/or the horizontal seam 26 may be joined by applying a sealant 38.

A gripping material 36 may be placed along an inner surface of the lower portion 22. The gripping material 36 may have a relatively high coefficient of friction. The gripping material 36 may be configured to secure the covering portion 20 on the user's head. The gripping material 36 may be applied in one or more strips that substantially or completely circumscribe the inner surface of the lower portion 22, though such is not necessarily required. The gripping material 36 may comprise silicone, though any material is contemplated.

A lower edge 40 of the lower portion 22 may be shaped to accommodate the user's head. In exemplary embodiments, the lower edge 40 may comprise a tapered portion 42 which may be configured to allow a rear edge of the covering portion 20 to fall on or below the user's hair line on the back of the head while allowing a front edge of the covering portion 20 to fall on or above the user's eyebrow line in the front of the head.

The swim cap 10 may be created by cutting, from a piece of stretchable and waterproof material, the first lower piece 23A and the second lower piece 23B, thereby forming the lower portion 22 of the covering portion 20. The first, second, and third upper pieces 25A, 25B, and 25C, respectively, may be cut from the material to form the upper portion 24 of the covering portion 20. The the first upper piece 25A may be sewn to the second upper piece 25B along the first vertical seam 28A. The second upper piece 25B may be sewn to the third upper piece 25C along the second vertical seam 28B. The first lower piece 23A may be sewn to the second lower piece 23B along the first vertical seam 28A. The lower portion may be sewn to the upper portion 24 along the horizontal seam 26.

The strap 30 may be cut form the same or a different piece of material. The hooks 32 may be sewn to each end of the strap 30. The loops 34 may be sewn to the lower portion 22. The gripping material 36 may be applied to the inner surface of the lower portion 22. The sealant 38 may be applied along the first vertical seam 28A, the second vertical seam 28B, and the horizontal seam 26.

The various features of the swim cap 10 and/or the construction techniques described herein may improve the durability and comfort of the swim cap 10. For example, without limitation, the use of a multi-piece construction (e.g., first, second, and third upper pieces 25A-C and first and second lower pieces 23A-B) and multiple seams (e.g., first and second vertical seams 28A-C and horizontal seam 26) may improve comfort by allowing greater stretch in the swim cap. This may also improve durability by spreading forces across multiple seams which results in lower stresses and less chance for failure. Of course, these are just exemplary improvements which are provided for purposes of example and are not intended to be limiting.

The various seams 28A-C and 26 may be joined by way of stitching, though other methods for joining are contemplated as alternatives, or in addition to, stitching such as, but not limited to, heat sealing, gluing, stapling, fastening, bonding, or the like.

Figure 7:
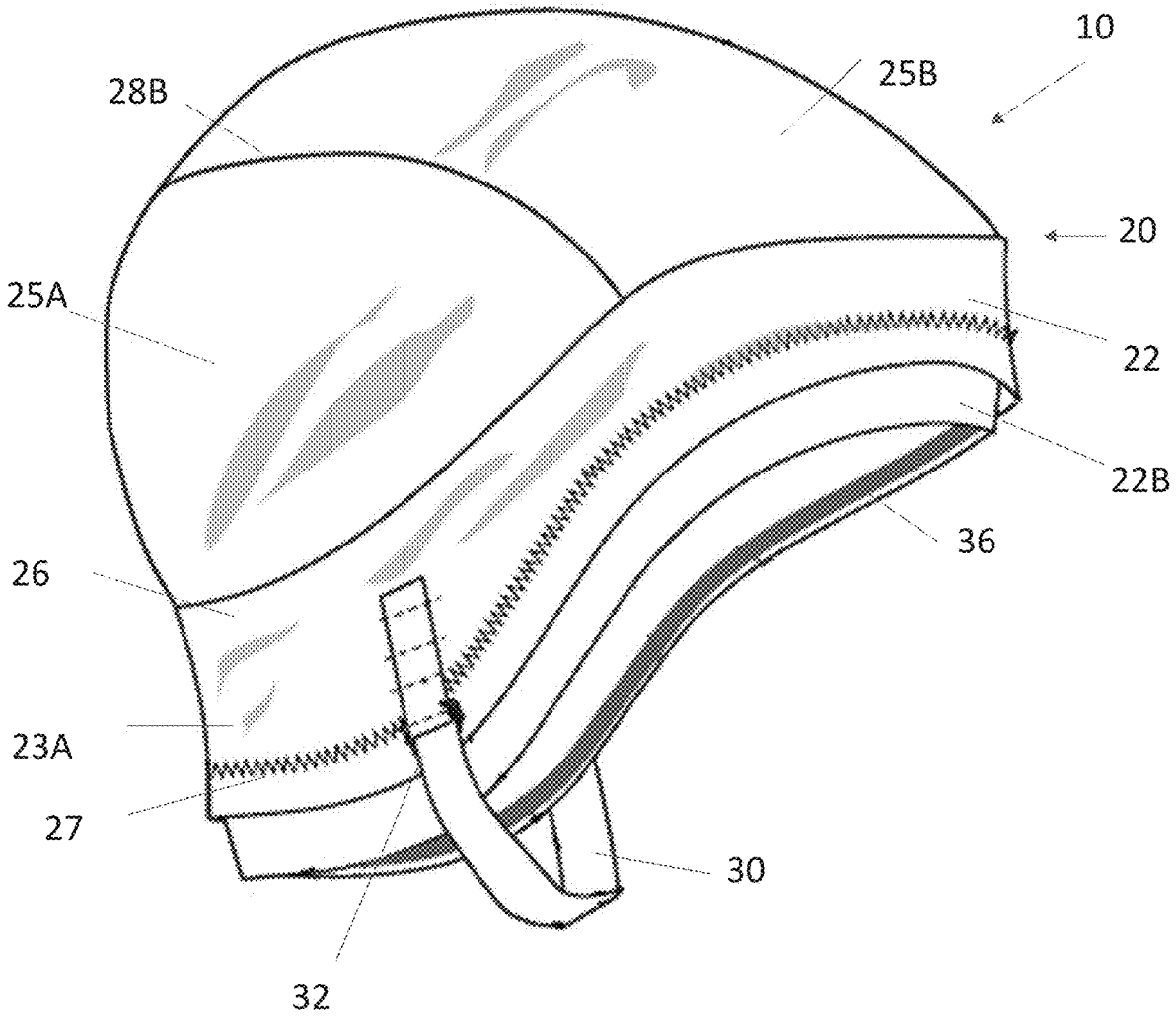
FIG. 7 is a front perspective view of another exemplary swim cap.
Figure 8:
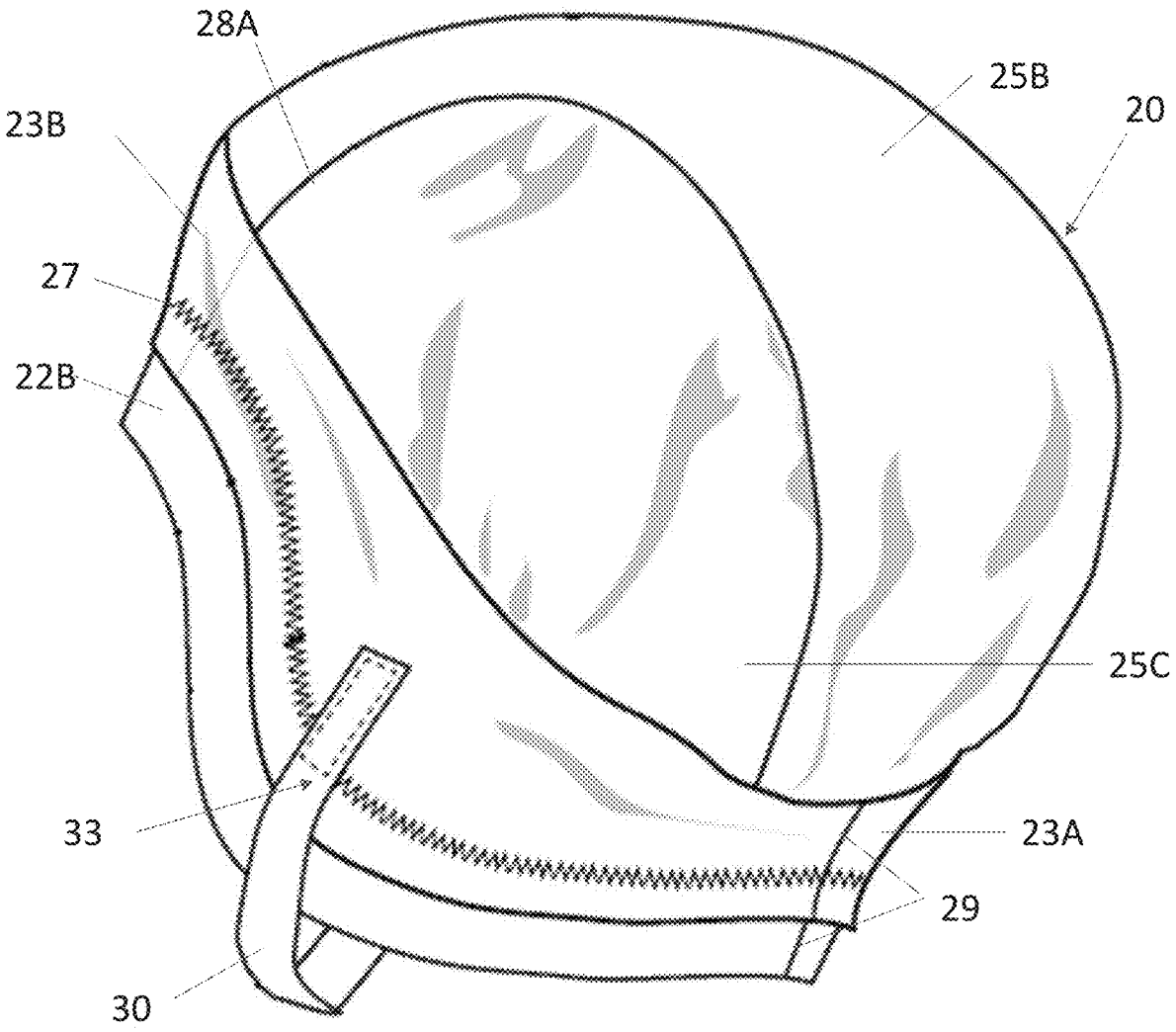
FIG. 8 is a rear perspective view of the swim cap of FIG. 7.

FIG. 7 is a front perspective view of another exemplary swim cap 10, and FIG. 8 is a rear perspective view of the swim cap 10. Like numbers are used to describe the same or similar features. A second lower portion 22B may be provided. The second lower portion 22B may have a lower edge which extends below the lower edge of the lower portion 22. The second lower portion 22B may be joined to the lower portion 22 by a seam 27. Such joining may be accomplished by stitching, heat seal, some combination thereof, or the like. The gripping material 36 may be provided along the second lower portion 22B. One or more lower portion seams 29 may connect the first lower piece 23A to the second lower piece 23B. Such joining may be accomplished by stitching, heat seal, some combination thereof, or the like. A hook and look type fastener 33 may be provided on one or more ends of the strap 30 and the lower portion 22 for securing the strap 30 to the covering portion 20.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A method for producing a swim cap comprising the steps of:

cutting out the following from a stretchable and waterproof material:

a plurality of lower pieces, the plurality of lower pieces comprising a first tapered piece and a second tapered piece;

a first upper piece shaped as a semi-circle;

a second upper piece shaped as a quadrilateral; and a third upper piece shaped as a semi-circle;

forming an upper portion by:

joining the first upper piece to the second upper piece along a first vertical seam;

joining the second upper piece to the third upper piece along a second vertical seam;

wherein said first, second, and third upper pieces form the upper portion, the upper portion being shaped as a dome when the first, second, and third upper pieces are joined;

forming a lower portion by:

joining each piece of the plurality of lower pieces along vertical seams to form a band with the lower pieces arranged such that the first tapered piece is opposing the second tapered piece; and wherein the plurality of lower pieces collectively define a lower edge of the lower portion that comprises the opposing tapered pieces, the opposing tapered pieces extending downwards from a front of the swim cap to a back of the swim cap; and joining the lower portion to the upper portion along a horizontal seam.

2. The method of claim 1 wherein:

the lower portion is joined to the upper portion along the horizontal seam by way of a heat seal;

the first upper piece is joined to the second upper piece along the first vertical seam by way of a heat seal;

the plurality of lower pieces are joined along the vertical seams by way of heat seals; and the second upper piece is joined to the third upper piece along the second vertical seam by way of a heat seal.

3. The method of claim 1 wherein:

the lower portion is joined to the upper portion along the horizontal seam by way of stitching;

the first upper piece is joined to the second upper piece along the first vertical seam by way of stitching;

the plurality of lower pieces are joined along the vertical seams by way of stitching; and the second upper piece is joined to the third upper piece along the second vertical seam by way of stitching.

4. The method of claim 1 further comprising the steps of:

cutting, from another piece of material, a strap;

sewing a hook to at least one end of the strap; and sewing a loop to the first tapered piece or the second tapered piece.

5. The method of claim 1 further comprising the steps of:

applying a gripping material having a higher coefficient of friction compared to said stretchable and waterproof material to the inner surface of the lower portion.

6. The method of claim 1 wherein:

at least one of the vertical seams of the lower portion are aligned with the second vertical seam.

* * * * *